US007817048B2

(12) United States Patent
Rouse et al.

(10) Patent No.: US 7,817,048 B2
(45) Date of Patent: Oct. 19, 2010

(54) FIRE EXTINGUISHING SYSTEMS AND METHODS

(75) Inventors: J. Paul Rouse, Forney, TX (US); Charles Schaefer, Garland, TX (US)

(73) Assignee: Guardian Patent, LLC, Dallas, TX (US)

( * ) Notice: Subject to any disclaimer, the term of this patent is extended or adjusted under 35 U.S.C. 154(b) by 320 days.

(21) Appl. No.: 12/130,523

(22) Filed: May 30, 2008

(65) Prior Publication Data

US 2009/0294141 A1 Dec. 3, 2009

(51) Int. Cl.
*G08B 17/12* (2006.01)

(52) U.S. Cl. ..... 340/577; 340/506; 340/628; 340/632; 340/584; 340/540; 169/65; 137/78.4

(58) Field of Classification Search ..... 340/577, 340/540, 500, 655, 531, 506, 628, 693.6, 340/632, 584; 219/412–414; 169/65, 56, 169/54, 60; 307/116; 137/78.1, 78.4
See application file for complete search history.

(56) References Cited

U.S. PATENT DOCUMENTS 4,773,485 A 9/1988 Silverman
4,834,188 A 5/1989 Silverman
5,127,479 A 7/1992 Stehling et al.
5,297,636 A 3/1994 North
5,697,450 A 12/1997 Stehling et al.
5,871,057 A 2/1999 Stehling et al.
5,939,992 A * 8/1999 Devries et al. ..... 340/657
6,029,751 A * 2/2000 Ford et al. ..... 169/60
6,044,913 A 4/2000 Stehling et al.
6,952,169 B1 * 10/2005 Simtion ..... 340/577
7,199,721 B2 * 4/2007 Shirlee ..... 340/628

* cited by examiner

*Primary Examiner*—Anh V La
(74) *Attorney, Agent, or Firm*—Millen, White, Zelano & Branigan, P.C.

(57) ABSTRACT

A fire extinguishing system for suppressing fires on cook stoves, fryers or other heating or heated devices with fire suppressant dispensed through nozzles is powered by batteries which provide current for both a detection circuit including a pair of heat sensors and control circuitry and current for a gas or electric house current shut-off. The appliance shut-off device is operated by the standard hardwired interconnect cable that provides a signal between the control board and shutoff device or by an optional sonic receiver assembly that is acoustically tuned to detect an audible alarm emitted by a signal from the main control board. Preferably, the heat sensors are diodes, but in alternative embodiments may be thermistors or active temperature sensors. Mounting of heat sensors and nozzles are facilitated by tees and 90 degree elbows. While the standard interconnect cable is usually used between the control circuitry and shutoff device, a wireless link, such as the sonic receiver assembly, may also be used with the shutoff device.

9 Claims, 13 Drawing Sheets

FIRE EXTINGUISHING SYSTEMS AND METHODS

FIELD OF THE INVENTION

This invention relates to automatically operated fire extinguishing systems and methods. More particularly, this invention relates to automatically operated fire extinguishing systems and methods especially useful for warning of fires and extinguishing fires occurring on commercial or residential cook stoves, fryers and ranges.

BACKGROUND ART

U.S. Pat. Nos. 4,773,485, 4,834,188, 5,127,479, 5,697,450, 5,871,057 and 6,044,913, each assigned to the assignee of the present invention, disclose systems for extinguishing fires which occur on residential cook stoves, fryers and ranges. U.S. Pat. No. 6,044,913 is specifically incorporated in this application by reference in its entirety. While the systems disclosed in these patents have gained wide acceptance and function effectively to extinguish fires on residential cook stoves and ranges and fryers, these patents rely on an array of heat sensing elements coupled to one another with cables strung around the internal periphery of range hoods. Since these systems require at least some skill in mechanical assembly and require adjustments in cable length, they are systems which are somewhat difficult for the average home owner to install. Moreover, these systems are relatively expensive.

Attempts have been made to develop electronic systems which do not have the difficulties of cable systems. U.S. Pat. Nos. 4,830,116 and 4,887,674 are exemplary of such systems, but the systems disclosed in these patents have not been commercialized. Other electronic systems are exemplified by U.S. Pat. Nos. 5,186,260 and 5,207,276; however, these systems rely on twisted insulated conductors which limit alarm signals upon the insulation melting. These are irreversible systems which are also subject to degradation over time. In addition, prior art arrangements are not easy to install and require drilling, measuring, screwing and bolting, which procedures tend to discourage their installation.

In view of the aforementioned considerations, there is a need for fire extinguishing systems, suitable for commercial and residential cook stoves, fryers and ranges, as well as other heating and heated devices, which are very easy to install and less expensive than the aforementioned, prior art systems.

Current fire extinguishing systems are hardwired to avoid grounding difficulties which cause unnecessary shut-off of electricity and gas due to the presence of sonically triggered alarm systems, thus limiting the systems to situations where only hardwiring can be utilized. Consequently, fire protections systems as disclosed in U.S. Pat. No. 6,044,913 are not conveniently installable in all situations. Accordingly, there is need of an arrangement that allows use of acoustically triggered shut-off systems. Moreover, there is a need for a way to conveniently incorporate add-on features with cook stove fire extinguishing systems generally configured as present commercially available systems.

SUMMARY OF THE INVENTION

It is a feature of the present invention to provide new and improved fire extinguishing systems for residential and commercial cook stoves, fryers and ranges, which are relatively easy to install and are relatively inexpensive.

With this feature and other features in mind, in a preferred embodiment, the present invention is directed to a system for detecting and suppressing fires on cook stoves and fryers being energized by a source of gas or electric current. The system includes a heat sensor circuit comprised of one or more heat sensors, which are connected to a control circuit. When the heat sensors detect increased temperature representative of a fire, the control circuit sounds an audible alarm. The audible alarm trips an acoustical switch that is separated from the electrical shut-off which in turn triggers the fire extinguisher solenoid latch mechanism discharging a fire extinguisher and activating a general purpose contact closure output.

In accordance with the invention, when hardwiring cannot be used, a sonic activated cut-off assembly, triggered by the audible alarm, is placed between the burners and the source of gas or electric current to interrupt the flow of gas or electric current from the source to the burners.

In accordance with another aspect of the invention, permanent magnets are used to retain a nozzle and heat sensor in proximity to cook stove burners for the purpose of suppressing fire.

Upon further study of the specification and appended claims, further features and advantages of this invention will become apparent to those skilled in the art.

BRIEF DESCRIPTION OF THE DRAWINGS

Various other features and attendant advantages of the present invention will be more fully appreciated as the as the same becomes better understood when considered in conjunction with the accompanying drawings, in which like reference characters designate the same or similar parts throughout the several views, and wherein.

DETAILED DESCRIPTION OF THE DRAWINGS

Figure 1:
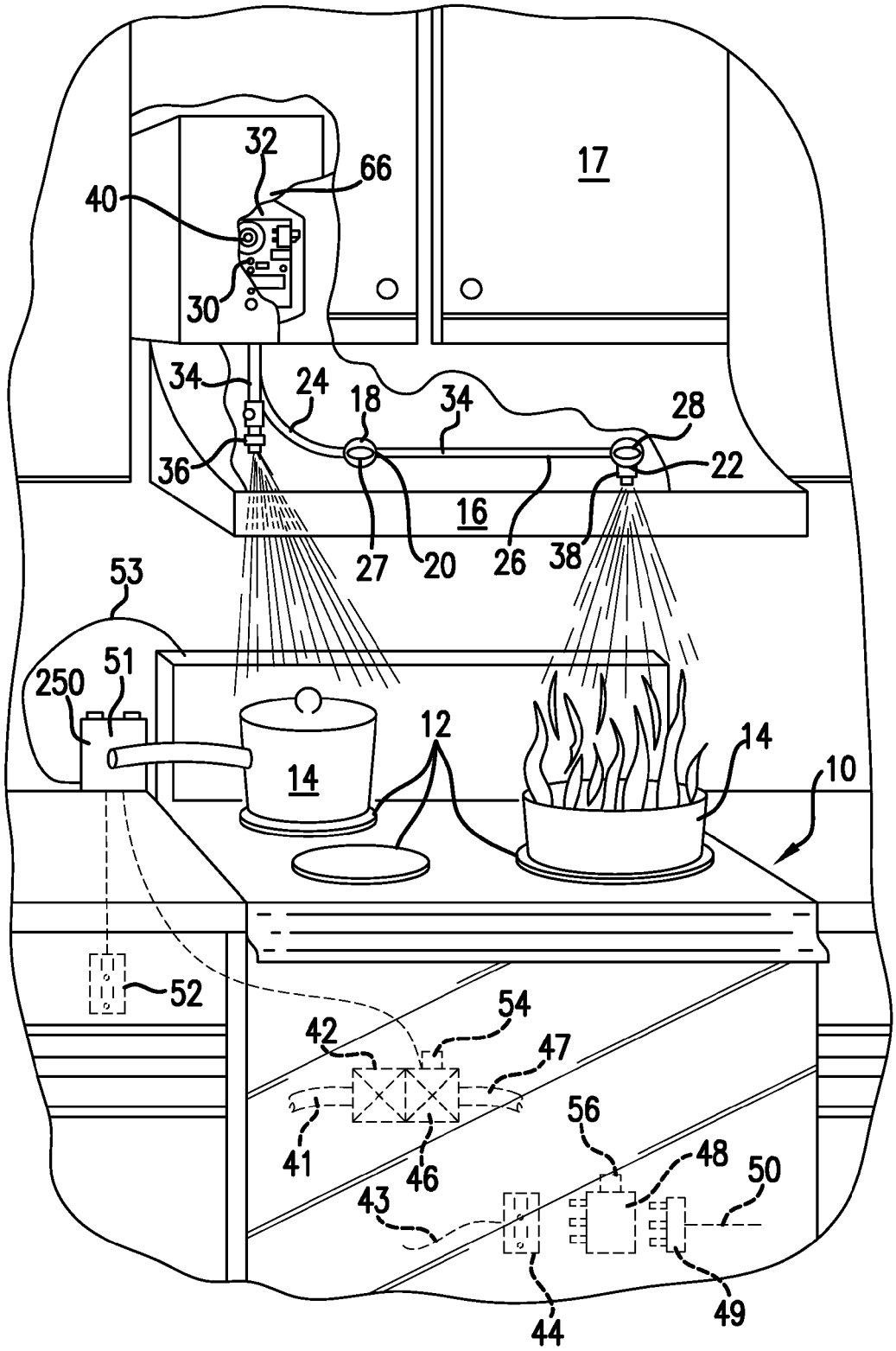
FIG. 1 is a pictorial view of a fire extinguishing system configured in accordance with the principles of the instant invention as used with a residential cook stove.
Figure 2:
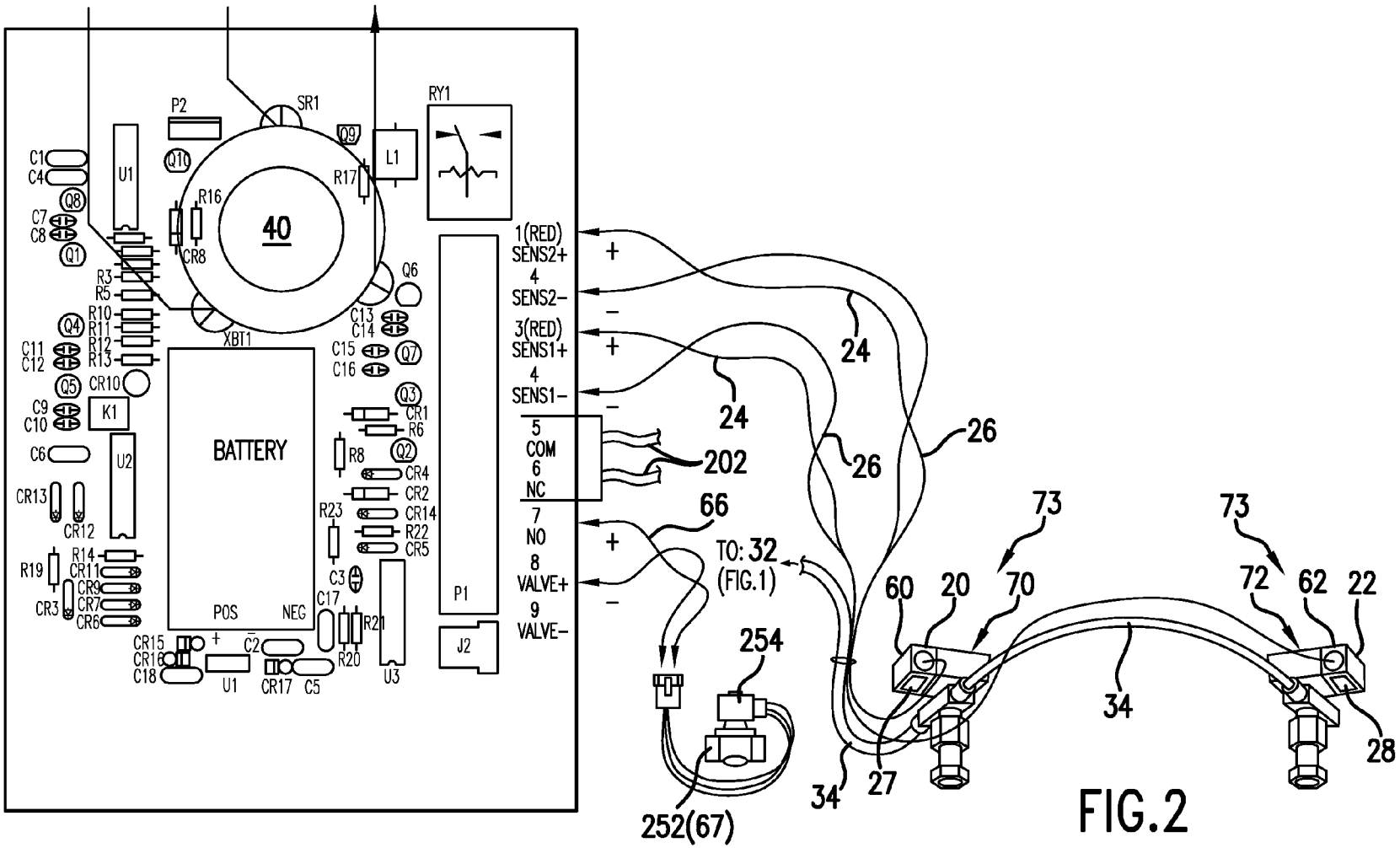
FIG. 2 is a diagrammatical illustration of components of the system employed in FIG. 1.
Figure 3:
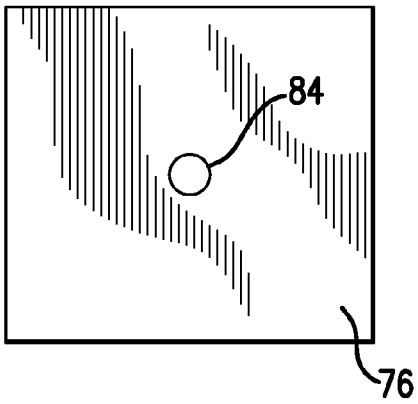
FIG. 3 is a top view of a housing containing a permanent magnet for attaching a nozzle fitting to a stove hood.

FIGS. 1 and 2

FIG. 1 depicts a residential range cook-top, designated generally by the numeral 10, which has four burners 12 thereon for cooking food in pans or pots 14. Disposed above the cook-top stove 10 there is a range hood 16 attached to a cabinet 17.

In accordance with the principles of the present invention, mounted within hood 16 are heat sensor sub-assemblies 20 and 22, connected by leads 24 and 26 to an electric control circuit 30 disposed within cabinet 17. Note that two heat sensors 27 and 28 (preferably part nos. 305-1 and 305-2) are shown as are preferably used in residential systems; however, the number of heat sensors could vary depending upon the specific application. The electronic control circuit 30 is housed either with or proximate a canister of fire extinguisher material 32 which is connected by a tubular line 34 to first and second dispensing nozzles 36 and 38. Note that two dispensing nozzles are shown, as is preferable in residential systems; however, the number could vary depending upon the specification of the application.

When a pan 14 containing food is left on a burner 12 of the stove with the burner on and forgotten about, moisture may evaporate from the pan and the grease or other food in the pan may ignite. If this occurs, the electrical properties of heat sensors 20 and 22 change due to the elevated temperature caused by the fire. The heat sensors 20 and 22 are connected over lines 24 and 26 to the control circuit 30 allowing the control circuit to sense the elevated temperature caused by the fire When an elevated temperature representative of a range top fire is sensed by the control circuit 30, the control circuit transmits a signal which activates the solenoid latching mechanism causing the fire extinguisher 32 to extinguish fluid to discharge through the tubular line 34 to the first and second nozzles 36 and 38.

In accordance with the present invention, the heat sensor sub-assemblies 20 and 22 are either thermistors (resistive devices that have a resistance proportional to temperature), diodes (conductive devices that have a forward voltage proportional to temperature), or an active temperature sensor (a sensor or sensor circuit which has a voltage, current or resistance output proportional to temperature). In a preferred embodiment, the heat sensors 20 and 22 are diodes.

Upon the occurrence of a fire, the electronic control circuit 30 activates an audible alarm 40 which emits a high decibel signal to alert occupants of the fire.

The electronic control circuit 30 also preferably contains an auxiliary relay providing a switch to activate either the gas or electric shutoff device using an interconnect cable. In the event that the optional sonic receiver assembly is used to activate the electric or gas shutoff device, the auxiliary relay may be used for the capability for activating remote devices such as emergency power shut-offs, emergency lighting, security systems, automatic telephone dialers, or wide area alarm systems. These remote devices may be wired directly to the relay on terminal strip position 5, 6, and 7 of electronic control circuit 30, or the relay could activate another interface relay for the purpose of transmitting low level RF, ultrasonic sound, infra-red or laser to be used as a trigger. Additionally, these remote devices may be triggered by detecting the sound signature of the audible alarm 40.

As is seen in FIG. 1, if the stove is a gas stove 10, then behind the cook-top range is a gas line 41 with a conventional, manually operated gas valve 42 for providing the range with cooking gas. In accordance with the principles of the present invention, a gas control box 51 is attached to the wall and receives electrical house current from outlet 52 to signal over line 53 a gas shut-off valve assembly 46 that is attached to a gas line 47 supplying the stove 10.

The normally closed gas shut-off valve assembly 46 may be activated by the following: 1) loss of power to the gas control box 51 as a safety feature; 2) the external optional sonic receiver (see FIG. 10) detecting an acoustically signal from the control circuit alarm 40 and switching the gas control box 51; 3) an interconnect cable from control circuitry 30 to control box 51. The gas control box 51 is powered by 115 vac supplied by electrical wall outlet 52.

As is seen in FIG. 1, if the stove is an electric stove 10, then behind the cook-top range is an electric house current AC line cord 50 with a three or four pronged plug 49 allowing connection to a conventional 220 volt electric wall outlet 44. In accordance with the principles of the present invention, a supplemental electric shut-off contactor assembly 48 is installed between the stove plug 49 and the wall receptacle 44. As will be explained in detail hereinafter, the electric shut-off contactor assembly 48 may be activated by the following: 1) loss of power to the electric shutoff (see FIG. 9) as a safety feature; 2) the external optional sonic receiver (see FIG. 10) detecting an acoustically signal from the control circuit alarm 40 and switching the electric shutoff; 3) the preferred standard interconnect cable from control circuitry 30 switching the electric shutoff. The electric shutoff is powered by 220 VAC supplied by electrical wall outlet 44 employed by FIG. 1.

Referring now to FIG. 2 wherein the various components of the system are illustrated in further detail. The extinguisher discharge nozzle assemblies 70 and 72 are attached to the underside of the range hood with permanent magnets 73. This means of attachment allows for ease of installation and allows the proper positioning of the nozzle assembly for specific applications. The heat sensor sub-assemblies 20 and 22 are each mounted in metal housings 60 and 62, respectively. In accordance with a preferred embodiment, each of the metal heat sensor housings 60 and 62 are positioned against the side of a nozzle assembly 70 and 72, and held in place by magnetic force of one of the magnets 73. The heat sensors 20 and 22 are electrically connected to the control circuit 30 by wiring 24 having high temperature insulation such as Teflon.

Figure 12:
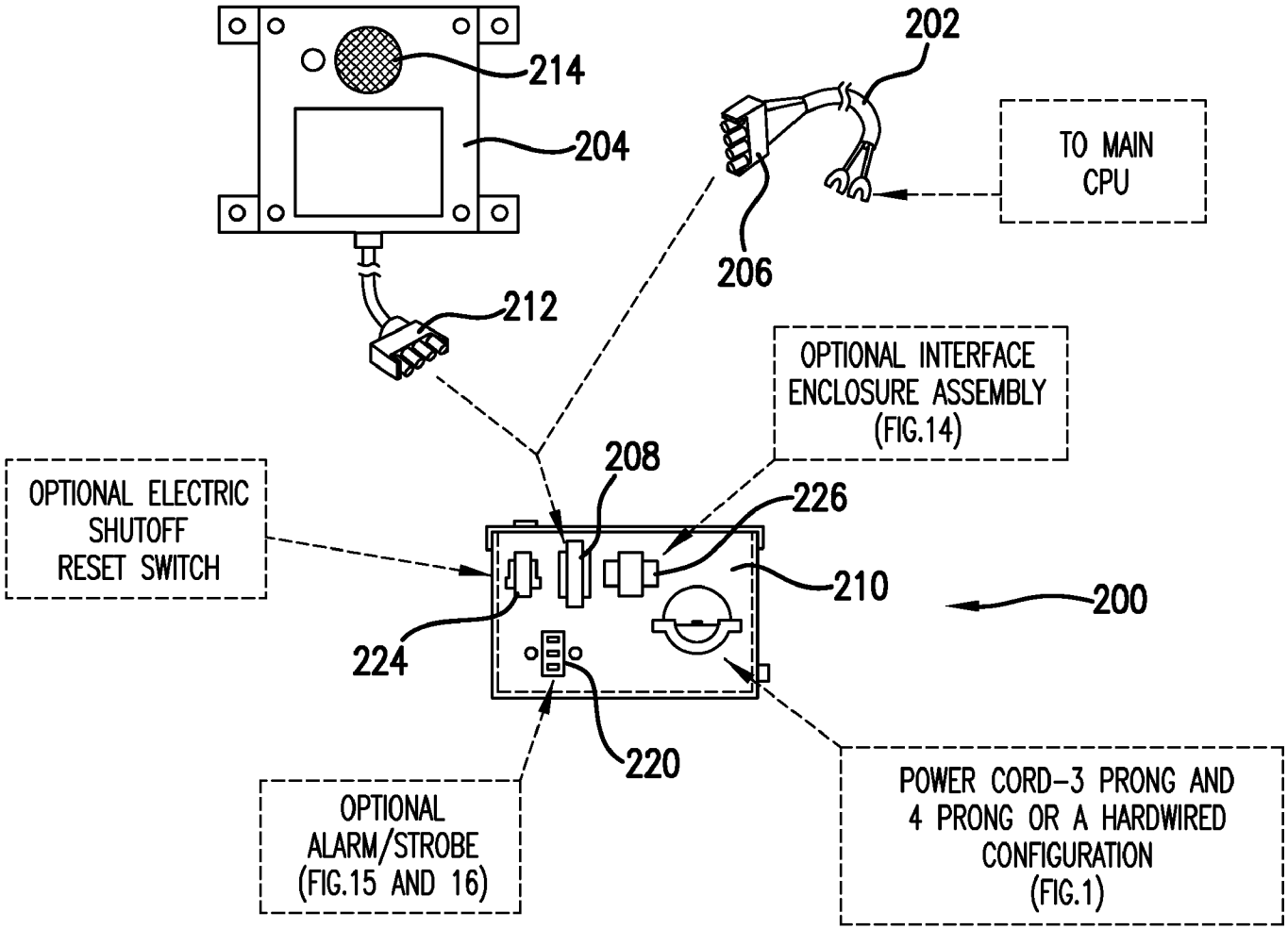
FIG. 12 is an overview diagram showing an interface arrangement according to the present invention for interconnection with an electric shutoff device.
Figure 13:
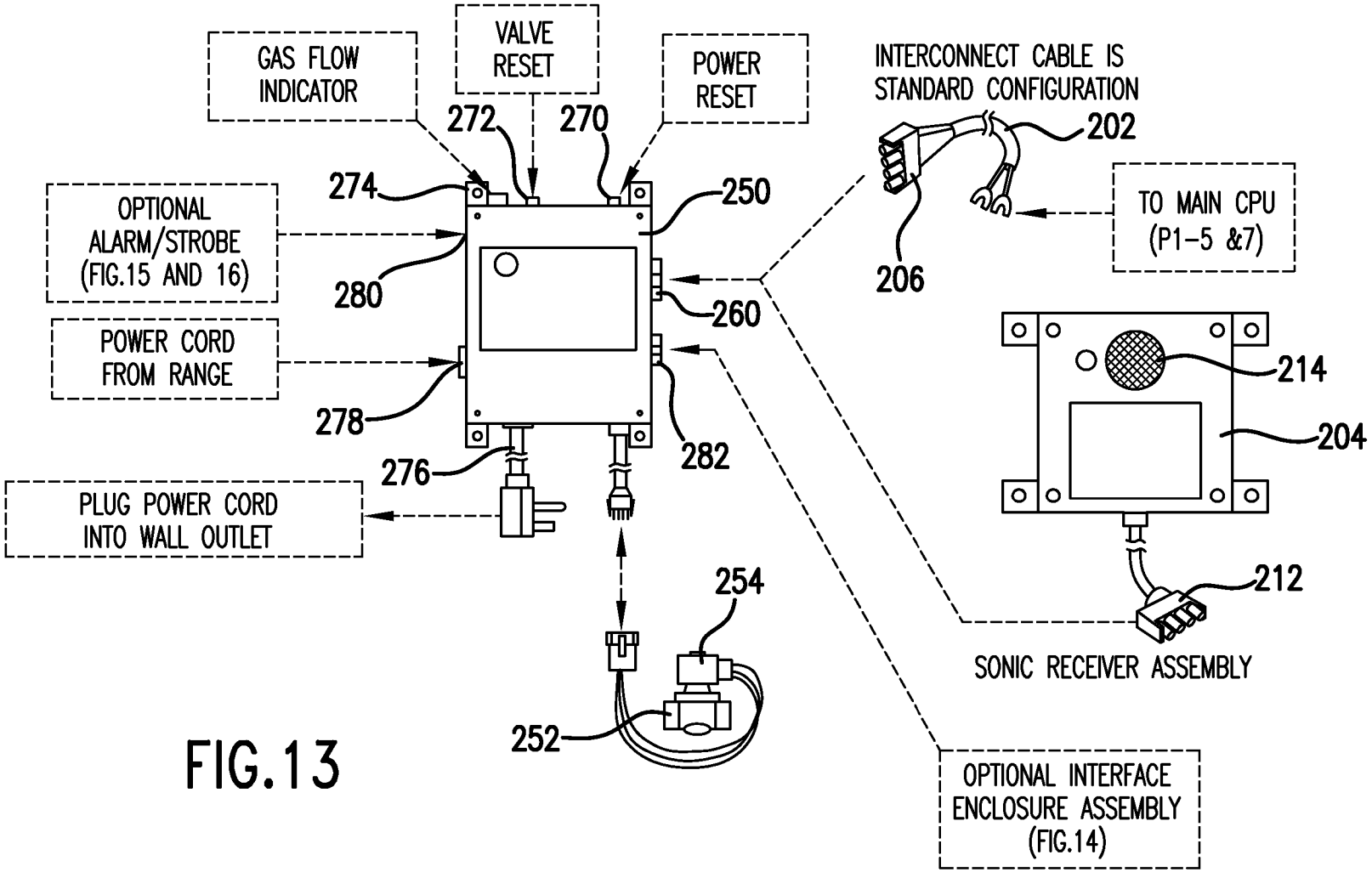
FIG. 13 is an overview diagram showing an interface arrangement according to the present invention providing interconnections with a gas shutoff device.

The audio alarm 40 emits an audio signal to draw attention to the hazardous condition causing the alarm, and, will cut off the gas or electricity to the stove 10 by the preferred interconnect cable and closing of contacts of relay circuitry 30 position 5 and 7 on terminal strip or detecting the audio signal through the optional interface of FIGS. 12 and 13 connected to the shutoff device. The control circuit 30 is connected by electrical wiring 66 to a solenoid 67. The solenoid is attached to a latching mechanism. When the solenoid 67 is energized by a signal from the control circuit 30, the solenoid 67 neutralizes the magnetic field created by permanent magnets in the solenoid. This in turn releases a plunger in the solenoid allowing a spring loaded latch to activate and release a spring loaded handle that was being held in place. The spring loaded handle then depresses the plunger in the valve to release the fire suppressant from the fire extinguisher canister 32 through the hose 34 to the nozzle assemblies 36 and 38. While a wired link using an interconnecting cable is preferred, an acoustic system is employed when there are installation limitations.

FIGS. 3, 4, 5 and 6

Figure 4:
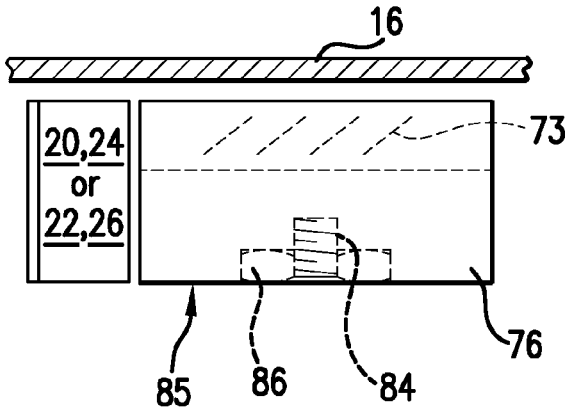
FIG. 4 is a side view of the housing of FIG. 3 showing the dotted lines of the permanent magnet, locking nut used in to be assembled to FIG. 5 and FIG. 6.
Figure 5:
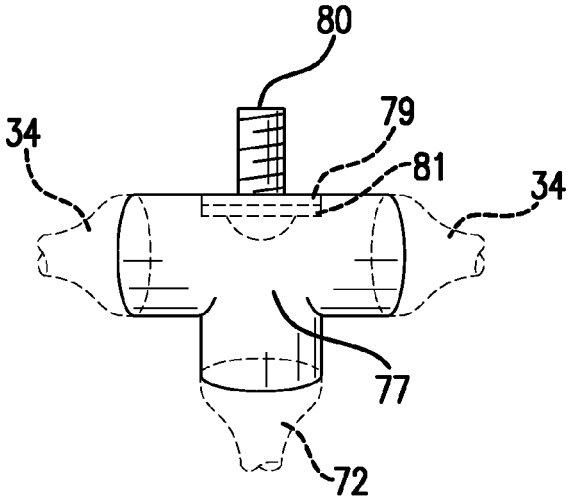
FIG. 5 is a side view of a Tee fitting used to connect a fire suppressant nozzle to inlet and outlet fire suppressant hoses, the fitting including a mounting screw for receipt in the housing of FIG. 3 and 4 using a locking nut.
Figure 6:
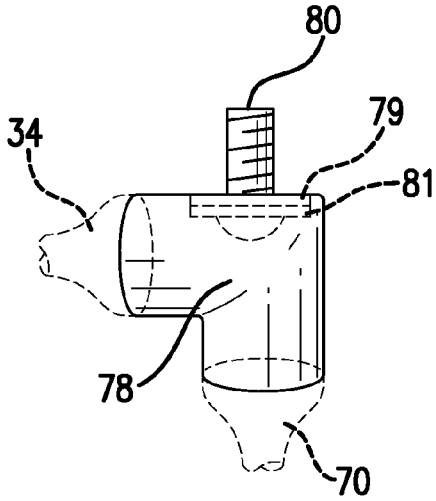
FIG. 6 is a side view of a 90 degree elbow fitting for connecting a fire suppressant nozzle to inlet and outlet fire suppressant hoses, the fitting including a mounting screw for receipt in the housing of FIG. 3 and 4 using a locking nut.

Each of the fittings 77 and 78 has a mounting screw 80, Teflon washer 79, and flat washer 81 (see FIGS. 4, 5 and 6). Each of the sensors 20 or 22 is disposed on the side of the housings 76 and the steel hood 16 (FIG. 1) so that the magnet 73 retains the entire assembly against the hood at the desired or proper location. The mounting screw 80 on the fittings 77 and 78 are 6-32×1¼ inches long. Usually Philips Pan Head, zinc plated.

In a preferred embodiment, the magnets 73 are magnets manufactured by Master Magnetics, Inc., (part #07207) and are rated at 100 lbs. pull. The magnet housings 76 are 2 inches long×2 inches wide×1 inch thick and are zinc chromate plated with ¼ inch hole 84 centered in the top of the housing. If necessary, corresponding magnets of other sizes and ratings as well as magnets from other manufacturers can be used.

The discharge hose assemblies of FIGS. 5 and 6 are secured to the magnet housing 76 at the tee and 90 degree elbow by inserting steel flat washer 81 first, then Teflon washer 79 onto the mounting screw 80. The mounting screw assembly is then inserted into the tee or 90 degree elbow and attached to the magnet housing 76 through mounting hole 84 with locking nut 86 flush to surface 85. The mounting screw 80 with steel flat washer 81 and Teflon washer 79 is secured on the inside of the magnet housing 76 with locking nut 86 which holds the discharge assembly secure, but still allows assembly to pivot to relieve stress/torque along the discharge hoses 34.

This method of attachment allows for ease of installation of the entire discharge hose assembly underneath the range hood without having to measure for drill holes. This method saves considerable time and labor during installation since the hoses 34 (FIGS. 1 and 2) are flexible and can pivot, if required, to circumvent various obstacles underneath the range hood, i.e., lights, fan, filter housing, etc. Moreover, the heat sensor housings 60 and 62 may also be attached to magnet housings 76 through magnetic force. This eliminates the labor involved in measuring for drilling holes as is done in traditional installations of the heat sensor housing in hoods since all one need do is attached the heat sensor housings 60 and 62 against the bottom of the hood 16 and the side of the magnetic housing 76 to hold the assembly in place with magnetic force.

FIG. 7

Figure 7A:
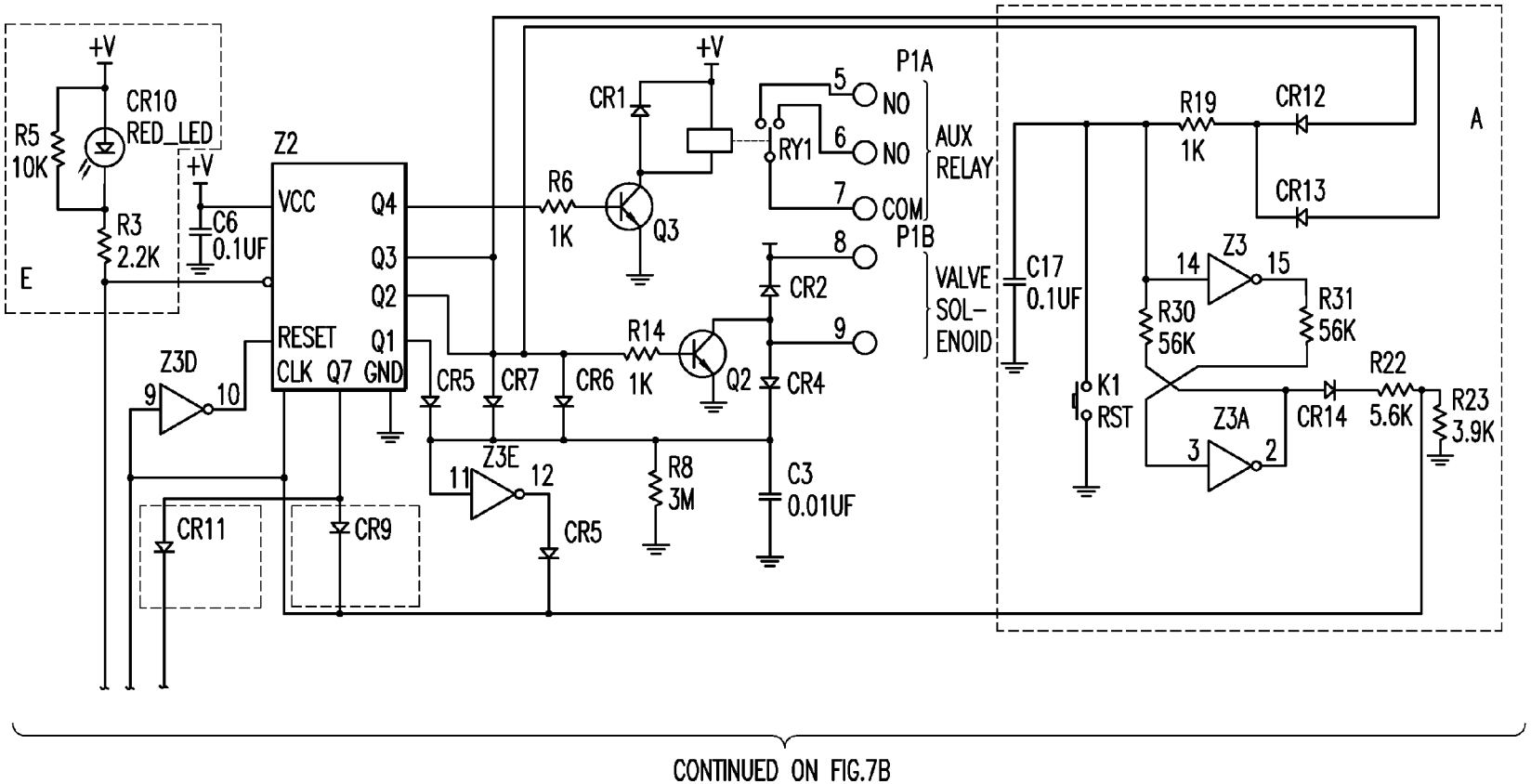
FIG. 7 is a schematic diagram of a control circuit employed with the system of FIG. 1.
Figure 7B:
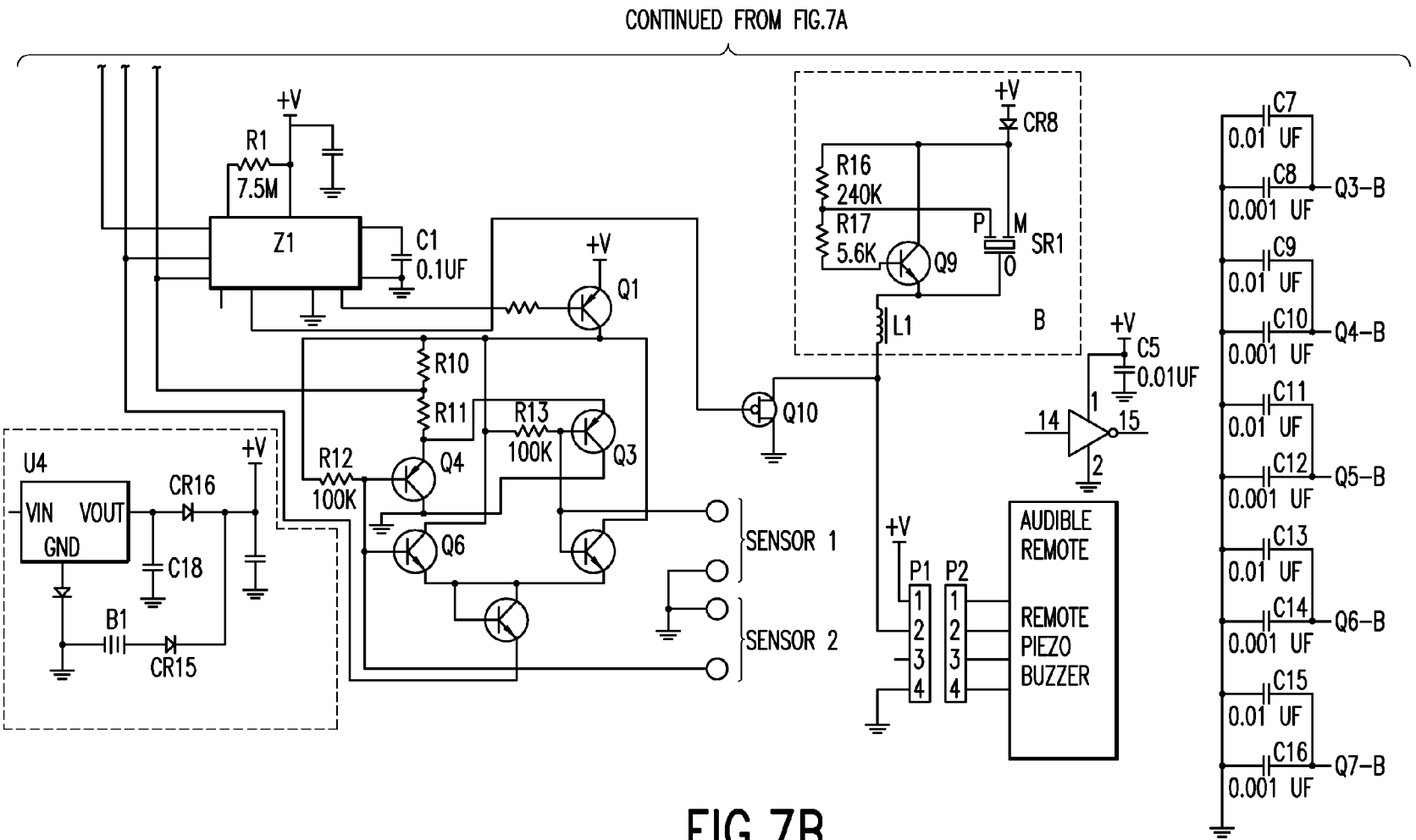

Referring now to FIG. 7, FIG. 7 is a schematic diagram of the control circuit 30 employed in the system of FIG. 1. The electronic control circuit 30 uses a nine volt battery as the main power source for the control circuitry. If the appropriate wall adapter is connected to J2 connector of the control circuit board 30, then the 9 volt battery becomes a battery backup power source. The power from a wall adapter is applied through J2 connector, AC voltage flows through U4 nine volt regulator, C18 provides a filter in parallel with the 9 volt battery. Power then flows through CR16, CR15 and C2 for rectification and clamping ripple on the voltage to the rest of the circuitry of the electronic control circuit 30. CR15 diode also helps establish the "low voltage" threshold indicator for the control circuit 30. A +V is applied to various components of the electronic circuitry 30 shown in FIG. 7. The control circuitry 30 includes a first integrated circuit U1 which is substantially similar to the integrated circuit used in smoke detectors and is preferably part number MC14468. The integrated circuit U1 includes an internal oscillator which provides a clock pulse with a period of approximately 1.16 seconds during non alarm conditions. Every 24 clock cycles, the impedance to common from U1 pin 5 drops loading the 9 volt battery source through R3 and CR10 red L.E.D. During the time the 9 volt battery is loaded, an internal reference voltage is compared to the V+ battery voltage. If the loaded battery voltage drops below approximately 8.1 volts, the audio alarm 40 chirps. Except when the 9 volt battery is being checked, during each clock cycle, internal power is applied to the integrated circuit U1 causing the input voltage on pin 4 to be lower than +V resulting in transistor Q1 (MPS3906) turning on and providing power to the heat sensor circuitry (Q4-7, R10-13), and the two heat sensor sub-assemblies 20 & 22 which is connected to the terminal strip P1 pins 1, 2 and 3, 4 FIG. 2. As the temperature surrounding the heat sensor sub-assemblies 20 and 22 rises, the voltage drop across the sensors in the heat sensor sub assemblies 20 and 22 decreases affecting the voltage feedback pin 15 of U1. If the feed-back voltage to U1 pin 15 is less than an internal preset reference, the integrated circuit U1 enters the alarm state sounding the alarm 40. The heat sensor sub-assemblies 20 and 22 comprise 4 series-connected silicon diodes each preferably part number 1N4148 along with a 0.01 mfd. and 0.001 mfd. capacitor for noise reduction. When Q1 switches on, current flowing through R12 and R13 into the diodes causes a temperature dependent voltage to appear at the bases of transistors Q4-Q6. The emitter voltage of the Q6-Q7 transistor pair is present to U1 pin 2 through transistor Q8. During normal temperature sensing operation, this voltage is sufficiently low that Q8 is reversed biased and therefore has no effect on circuit operation. However, if one or both sensor sub-assemblies 20 and 22 become open circuit, the voltage is pulled toward V+ which causes U1 pin 2 to enter the supervisory alarm state.

In the alarm state, the clocked pulse period within the integrated circuit U1 decreases to 40 milliseconds and the alarm 40, which is a piezoelectric horn, sounds with a frequency of approximately 3200 hertz and a duty cycle of approximately 100 milliseconds on and 60 milliseconds off. During the 60 milliseconds time interval when the horn 40 is off, the temperature sensed by the heat sensor sub-assemblies 20 and 22 is again checked, allowing an exit from the alarm state if the temperature has been reduced below the set point. Pin 2 of Integrated circuit U1 represents the alarm state and is high in the alarm state and low when not in the alarm state. When the integrated circuit U1 is in the alarm state, the low battery alarm is inhibited, but CR10 RED L.E.D. pulses approximately once per second.

Connected to pin 5 and pin 2 of the integrated circuit U1 is a second integrated circuit U2 which is preferably part number HCF 4017BE or 4017. Integrated circuit U2 has three input pins which are affected by the alarm state of integrated circuit U1. When the alarm state occurs, U2 pin 15 which is the reset input is driven low, U2 pin 14, the clock input which functions as an enable input, is driven high, and U2 pin 13, the enable input which functions as a clock input, toggles once per second as CR10 L.E.D. blinks. Subsequent to the first pulse for one second, the U2 pin 4 out-put becomes active for 1 second and turns on power transistor Q3 (MPS3904) through R6 activating relay RY1 and causing a contact closure of approximately one second. This contact closure output from RY1 is connected to terminal strip P1 pins 5,6, and 7 (see FIG. 2) allowing external equipment to be activated in the event a fire detect alarm occurs. Approximately one second after the U2 pin 4 becomes active, U2 pin 7 becomes active turning Q2 (MPS 3904) through R14 which draws current through the impulse activated extinguisher solenoid 33 via terminal strip P1 pins 8 and 9 which connect the fire extinguisher 32 to the tubular discharge line 34 (see FIG. 2). U2 pin 4 and pin 7 activates a third integrated circuit U3 pins 3 and 14 through CR12 and CR13. A latched condition occurs on U2 pin 14 and pin 6 to allow a continuous alarm 40 to occur until manually reset by K1 reset switch. A third integrated circuit U3, preferably part number CD4009UBE, is a hex inverter buffer and is used to invert the logic state of a signal where necessary.

The resistor R3 (2.2K) sets the current through CR10 L.E.D. to approximately 10 milliamps for 10 milliseconds duration of the battery check to monitor internal resistance of the 9 volt battery and provide a more accurate check of the battery. Resistor R5 (10K) is used to pull up the voltage at U1 pin 5 and U2 pin 13 to +V while the L.E.D. is off.

Battery life of the battery on circuit board 30 is improved by interrupting the power to the heat sensor sub-assemblies 20 and 22 and also circuitry associated with transistor Q1 except during the time the input to integrated circuit U1 pin 15 is actively monitored. Resistor R8 (3M) causes a trickle current of approximately three micro-amps to continuously flow through the impulse activated extinguisher solenoid 67. Should the solenoid be activated, or the wiring to the solenoid 67 be cut, resistor R8 causes the input of U3 pin 9 to be low and the output of U3 pin 12 to be high. This U3 pin 12 is connected to U1 pin 2 via diode CR5. When U1 pin 2 is forced high, the horn 40 sounds indicating a fault condition has occurred. Diode CR5 prevents the output of U3 pin 12 from affecting normal circuit operation when U3 pin 12 is in its normal low state. Diodes CR4, CR6 and capacitor C3 prevent the fault detection circuit from activating while U2 output is changing state during an alarm sequence operation. Transistor Q8 allows the output voltage of Q1 and the temperature sensor circuitry to bring U1 pin 2 high if the connection to either of the heat sensor assemblies 20 and 22 opens, again sounding horn 40 indication a fault condition.

The system operates in the "supervised mode"; meaning if a system or system component fails there will be an alarm output by 40 and the CR10 L.E.D. will flash once per second. A signal from U1 pin 10 activates transistor Q10. Transistor Q10 sends a signal to sounding horn 40 through coil L1 and connector P2 pin 2 for external alarm installation. When the system is in the supervised mode, the fire extinguisher 32 will not dispense suppressant. If one of the temperature sensors 27 or 28 malfunctions, the system will enter supervised alarm mode. In the event of a fire, if either of the sensors 27 or 28 detects t a fire and the system still operates to extinguish the fire. This function allows the system to police itself for system malfunctions, while also alerting the user to the system malfunction. The system is also able to detect a fire and extinguish the fire while in the supervised mode of operation.

Figure 8:
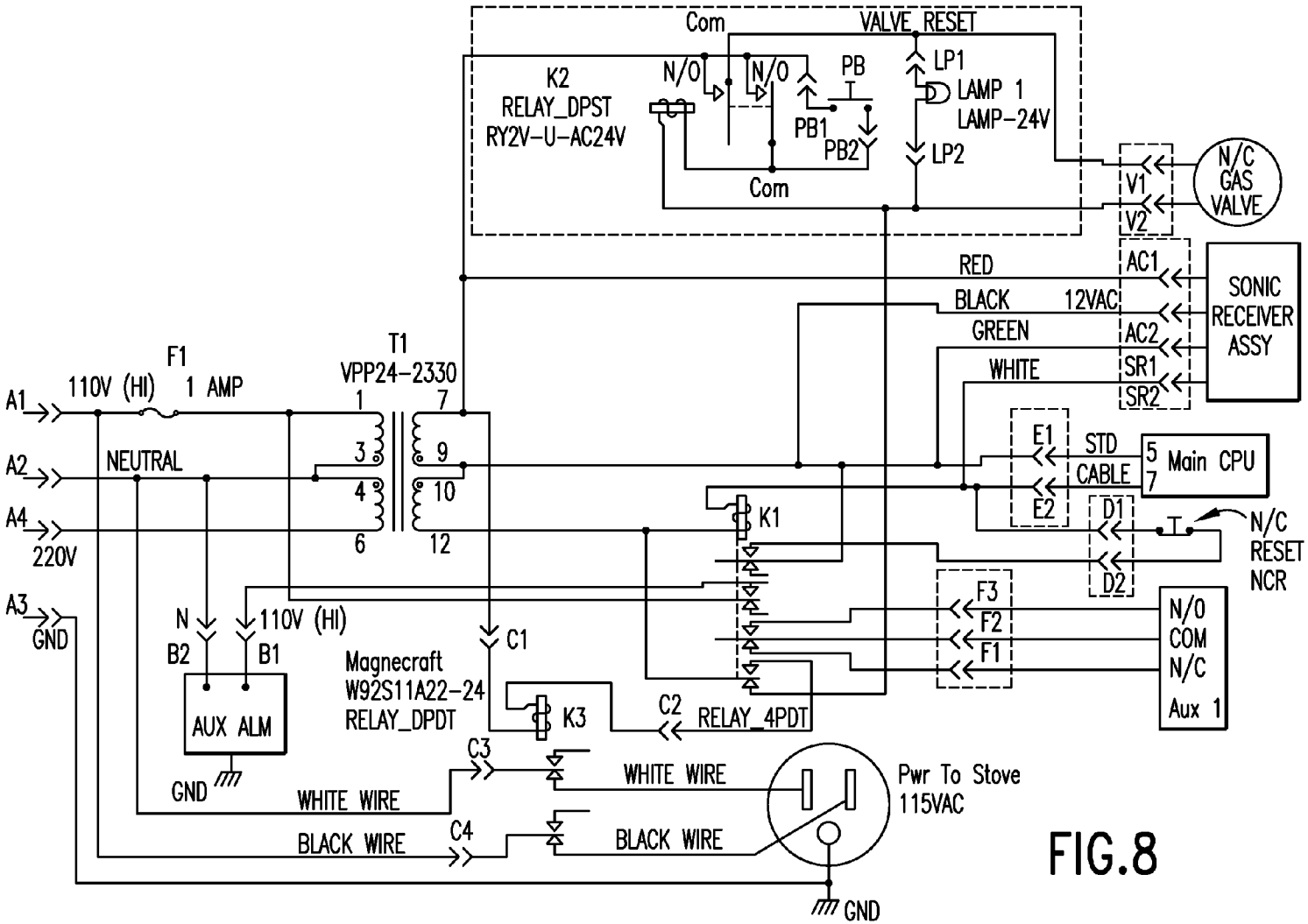
FIG. 8 is a schematic diagram of a cut-off assembly employed in the systems of FIG. 1.

FIG. 8 is a schematic diagram of gas shutoff assembly 51 employed in the systems of FIG. 1. The purpose of the electronic circuit shown in FIG. 8 is to shut off the gas supply by closing the energized normally closed solenoid valve 46. In the event of the piezoelectric horn or alarm 40 (FIGS. 1, 2, and 7) on the control circuit board 30 sounds and the optional sonic receiver assembly (FIG. 10) detects the audible signal therefore switching occurs to the control box consisting of the circuitry FIG. 8. This control circuitry then de-energizes the normally closed valve 46 shutting off the gas flow to the appliance.

Power of 115 vac supplied from wall outlet 52 flows through the circuitry 51 to the 24 vac step down transformer T1 pin 1 and pin 3 of the primary. Transformer T1 supplies 24 vac with a center tap splitting the secondary into one 24 vac and two 12 vac power sources. The secondary supplies 12 vac from T1 pin 12 to K1 Relay (4 PDT) coil and T1 pin 9 to E1 tab. The other side of K1 coil is connected to E2 tab. E1 and E2 tabs are the two input activation connections using the standard interface cable from the control circuit board 30. T1 pins 7 and 9 supplies 12 vac to AC1 and AC2 tabs to interface a connection for optional sonic receiver assembly if used.

The 24 vac is supplied from T1 pin 7 to one side of the coil of K3 through C1 tab. T1 Pin 7 also connects to the N/O contacts of K2. The other side of the K3 coil is connected to C2 tab to the N/O contact on K1.

When a signal is detected at tabs E1 and E2 by either optional sonic receiver assembly (FIG. 10) or through a standard interface cable, the momentary set of closed contacts completes the connection to energize K1 coil. When K1 coil is energized, four (4) functions occur simultaneously. The following occurs: 1) K1 coil latches itself through D1 and D2 and remains energized until reset, 2) Power is supplied to the Aux Alarm through tabs B1 and B2, 3) A set of dry contacts, COM,N/O and N/C are switched and latched through tabs F1, F2, and F3 until reset providing auxiliary devices to be activated, 4) K3 Relay is energized switching power flow 53 to the range top off and 24 vac power to the N/C gas valve 46 off. The valve 46 closes preventing gas flow to the stove.

To reset control box 51, a normally closed push button switch NCR when depressed de-energizes coil K1 allowing 3 of the 4 conditions listed above to be reset. The $4^{th}$ condition with the normally closed valve 46 will not let gas to flow to the stove until PB switch is depressed. When PB switch is depressed the normally closed valve 46 will be energized and allow gas to flow to the stove. This is a safety feature that forces the valve to be manually activated when everything is at optimum conditions.

Figure 9:
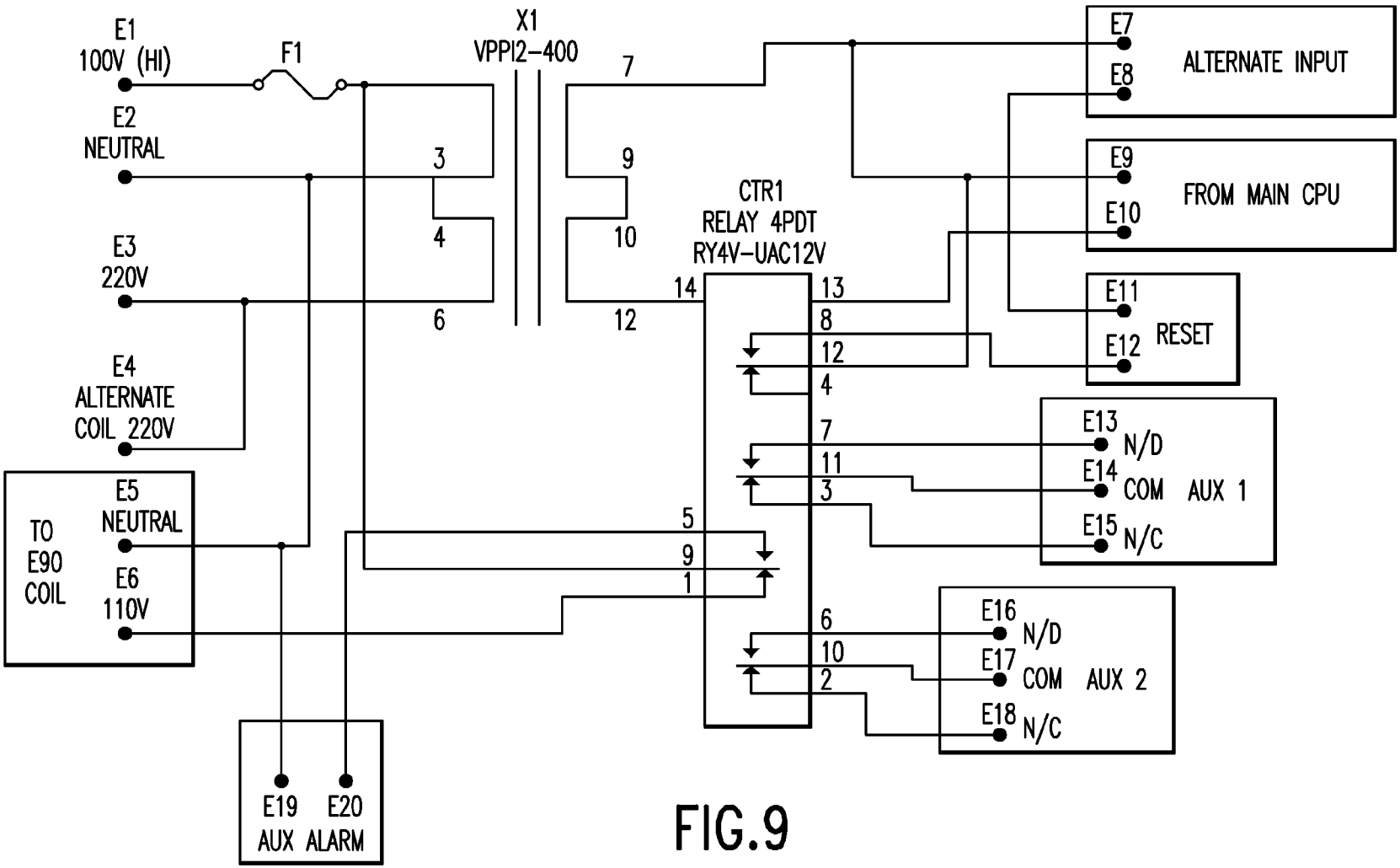
FIG. 9 is a schematic diagram of the switch electric cut-off assembly employed in the systems of FIG. 1.

FIG. 9 is a schematic diagram electric shutoff assembly 48 employed in system of FIG. 1, the purpose of the electronic circuit shown in FIG. 9 is to shutoff the electric power to the stove top in the event the piezoelectric horn 40 on the control circuit board 30 sounds indicating an alarm condition has occurred. The electric shutoff assembly is activated either by the optional sonic receiver assembly or the standard interface cable connected to E9 and E10 of 48 FIG. 1.

When electric shutoff is either plugged into wall outlet 44 or the circuit breaker to wall outlet 44 is reset, the output power from tabs E4 and E6 will energize the contactor coil therefore allowing current flow to the range top stove.

Power supplied 44 for circuitry 48 is applied to the primary side of step down transformer X1 part number VPP12-400. One side of the secondary 12 VAC pin 12 is supplied to CTR1 relay 4 PDT pin 14 of the relay coil. Pin 7 of the secondary coil is supplied to tab E9 through external connector. When an alarm condition occurs, CTR1 relay is energized by either the switched condition of the standard interface cable or the remote sonic receiver assembly. CTR1 relay simultaneously will latch the relay coil through a jumper on E11 and E12. This latched condition also latches the other three sets on contacts which are 1) Aux Alarm E19 and E28, 2) Aux 1 E13, E14, and E15, 3) Aux 2 E16, E17, and E18. Pins 5, 9, and 1 will switch power to E6 causing power loss to coil. This condition switches off current flow to the range top stove.

FIG. 10

Figure 10:
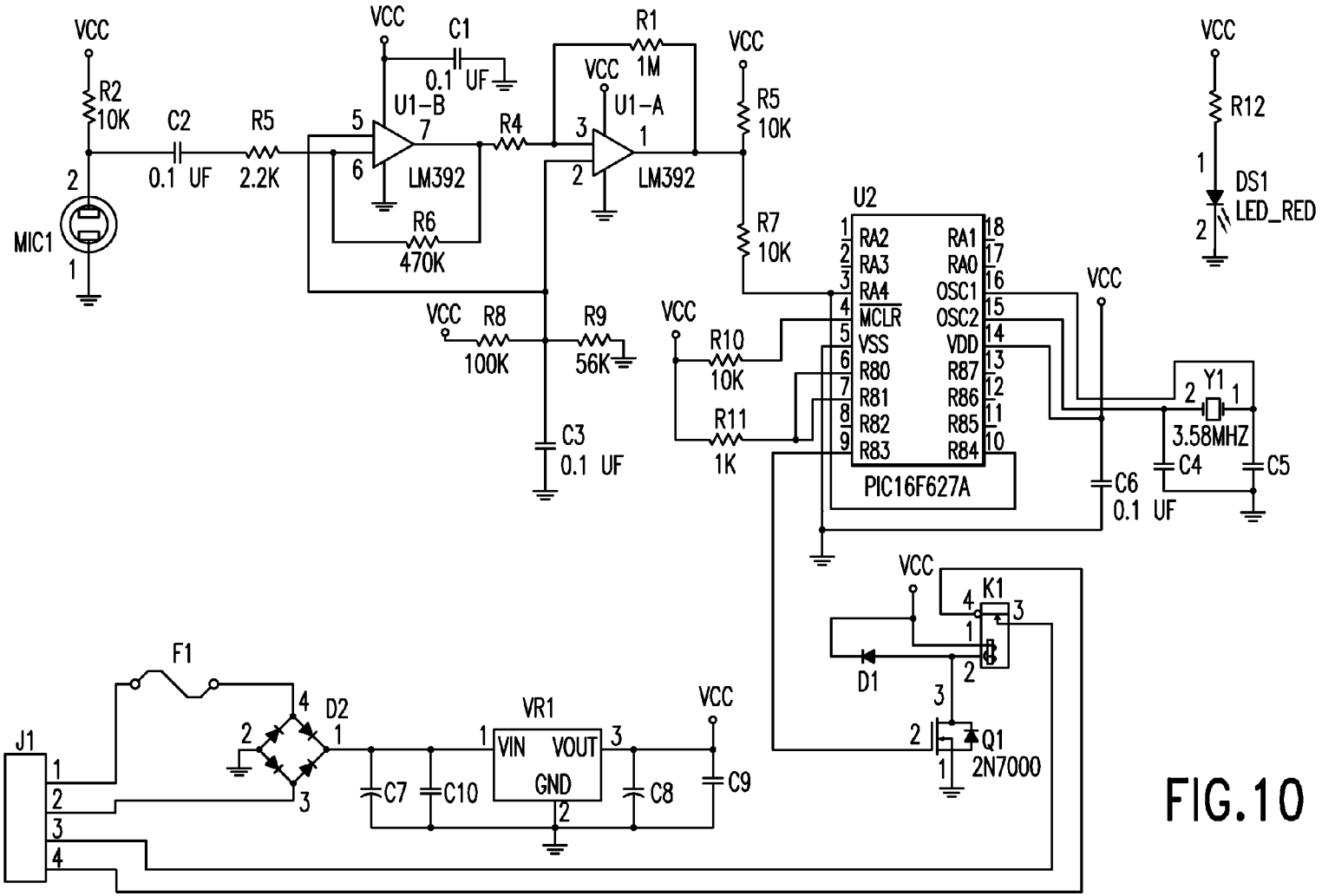
FIG. 10 is a schematic diagram of the optional sonic receiver assembly that is used with either gas or electric appliance shutoff devices.

FIG. 10 is a schematic diagram of the sonic receiver assembly used to sonically activate either the electric shutoff device 56 or gas shutoff device 51 employed in the system of FIG. 1. Power (12 VAC) is supplied from the shutoff device to the sonic receiver assembly through an interconnect cable attached to J1 pin 1 and 2 connector. The 12 VAC flows through F1 fuse to a bridge rectifier D2. The 12 VAC converts to DC voltage and flows through C7 (220 mfd) and C10 (0.1 mfd) to minimize voltage ripple and to VR1 5 volt regulator. The 5 Volt output on pin 3 in relation to ground supplies VCC to the rest of the circuit. The audio signal from the alarm 40 is detected by a microphone MIC1. The signal from MIC1 microphone flows through capacitor C2 (0.1 mfd) and R5 (2.2K) resistor that form a passive filter to attenuate frequencies outside the desired range to U1-B pin 6. Integrated circuit U1 preferably LM392 is a two stage (U1-A and U1-B) low power programmable operation amplifier, used to amplify and square the input signal from microphone MIC1. The signal at U1-B pin 6 is then amplified and configured by capacitor C1 (0.1 mfd) and R6 (470K). The signal flows to the second stage U1-A pin 3 to stabilize the output signal at U1-A pin 1. R8 (100 k), R9 (56K) and C3 (0.1 mfd) configures the amplification and squaring of the signal. The output signal of U1 flows to a second integrated circuit U2 (PIC 16F627A programmable processor). Oscillator Y1 supplies a clock pulse of 3.58 MHZ. to integrated circuit U2 pin 15 and 16. The input signal flow to integrated circuit U2 pin 3 and 10, is evaluated to determine the desired frequency of the original audible signal. All other noise frequencies other than the frequency that is generated by the alarm 40 on the circuit board 30 are discarded. The program in U2 allows the correct signal to be selected. When integrated circuit U2 recognizes the correct signal, transistor Q1 (2N7000) is activated to energize the coil of K1 Relay. A normally open set of contacts in K1 relay are closed which completes the loop through J1 connector for activation of either the electric 56 or gas 51 shut-off device.

FIG. 11

Figure 11:
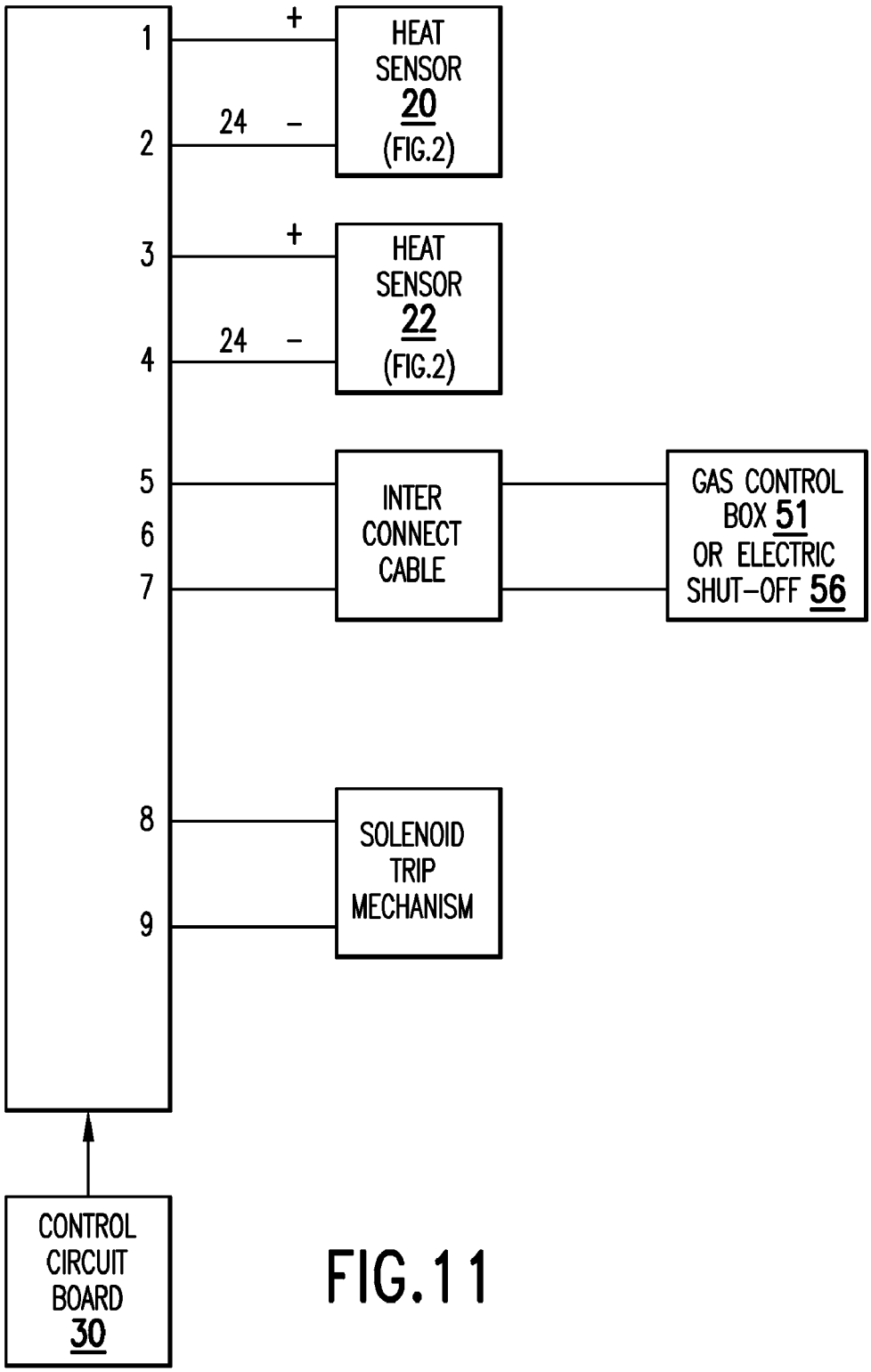
FIG. 11 reflects an installation wiring diagram showing the standard interconnect cable, sensor connections, and a solenoid latching mechanism for valve activation on the main control board of FIG. 2.

FIG. 11 is an installation block diagram showing interface connection wiring of solenoid trip mechanism, with direct wiring using the interconnect cable 202 to connect either to a gas shutoff assembly or electric shutoff assembly and heat sensors 20 and 22.

FIGS. 12-16

Referring now to FIG. 12, a system 200 provides for either a hardwire cable connection 202, which is a standard configuration, or for a sonic receiver assembly 204. Normally, the hardwire cable interconnection 202 is connected by an electrical connector 206 to an electrical connector 208 on an electric shut-off, interface arrangement 210 that may be configured as a panel or box. If the hardwire cable 202 cannot be used for interconnection to the electricity cut-off switch 48 in FIG. 1, then the sonic receiver assembly 204 can be connected by an electrical connector 212 to the electrical connector 208 on the interface arrangement 210. The sonic receiver assembly 204 has an acoustical receiver 214 therein which detects when an audible alarm is emitted by the horn 40 (see FIG. 1) on the control panel 30 shown in FIGS. 1 and 2. In this way, the sonic receiver assembly 204 is electrically separated from the grounding arrangement for sonic electric shut-off 48 in FIG. 1 and thus does not cause grounding problems which previously caused unintended premature shut-off of electric power, i.e. shut-off when there is no fire. These unintended shut-offs are caused by grounding problems in the circuitry. By providing the system of FIG. 12, the fire protection system of the present invention is available for practically all applications, some of which were previously precluded because either it is impossible or very inconvenient to use the standard cable 202 or because the standard cable is barred by code in same jurisdictions. Thus, Applicant's system is now available to consumers for retrofit and for new cook stove systems in situations where it was not previously available.

Figure 14:
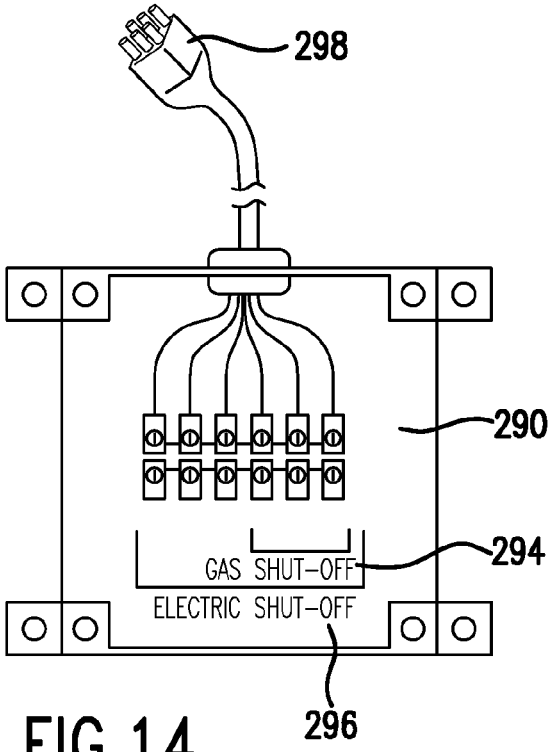
FIG. 14 is a block diagram showing a provision for interconnected wiring between the interfaces of FIG. 12 and both electric and gas shutoff devices.
Figure 15:
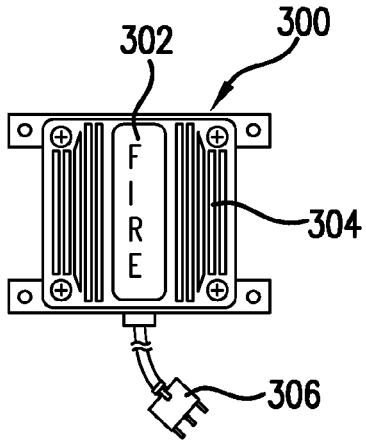
FIG. 15 is a block wiring diagram showing an alarm/strobe assembly.
Figure 16:
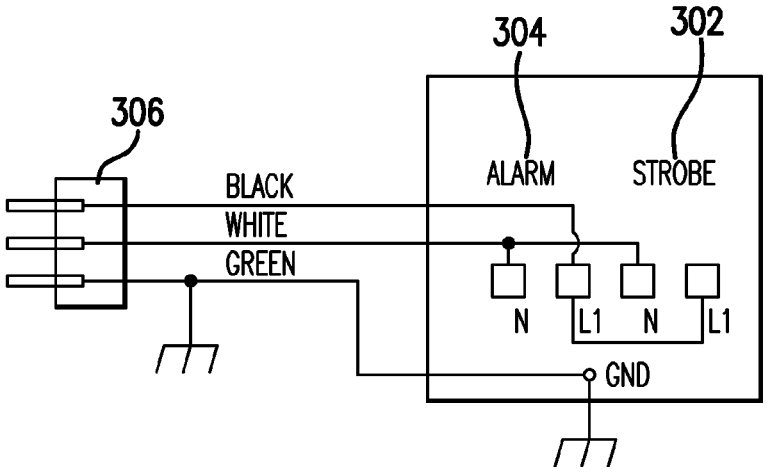
FIG. 16 is a front view of the device of FIG. 15.

The interface arrangement 210 has an additional electrical connector 220 for connections to the audible alarm and strobe assembly of FIGS. 15 and 16, as well as an electrical shut-off and reset switch 224, for resetting the shut-off switch to restore electrical current after a fire on the cook stove has been extinguished. In addition, the interface arrangement 210 includes an electrical connector 226 for connecting the interfacing assembly of FIG. 14 so as to connect to external devices such as automatic telephone dialers, monitored security alarm systems or other warning and protective equipment.

Referring now to FIG. 13, there is disclosed a gas shut-off control box 250 that operates a valve 252 which is normally held closed by spring pressure and is only held open when electric current is applied thereto. In other words, the valve 252 stays open only if a valve operator solenoid 254 is energized or receives electrical current. When the current is interrupted, the valve 252 closes. Consequently, if there is a power failure or if a fire occurs, gas to the cook stove is shut off. In accordance with the present invention, the gas shut-off control box 250 has an electrical connector 260 thereon to which the sonic receiver assembly 204 (the same unit shown in FIG. 12) is connected by an electrical connector 212. If a standard interconnect cable 202 connected by an electrical connector 206 can not be used, the sonic receiver assembly 204 is now usable because it is separated from control circuitry and will not cause premature activation of the gas shut-off.

The gas shut-off controlled box 250 also includes an electric power reset button 270, a valve reset button 272 and a gas flow indicator 274. A power plug cord 276 is provided for connecting with a wall outlet while a power cord connector 278 receives power cord from the cook-stove. The optional alarm strobe of FIGS. 15 and 16 is attached at outlet 280 and an interface 282 is provided for interfacing with automatic telephone dialers, monitors security alarm systems or other warning protective equipment using the assembly of FIG. 14. After a power failure or a fire occurs, the gas shut-off control box provides the power reset button 270 and valve reset button 272 as well as the gas flow indicated 274 to facilitate manual reset of the gas shut-off control box 250 at the stove. This arrangement ensures that all conditions of safety are met before reinstating cooking conditions.

Referring now to FIG. 14, it is seen that an interface enclosure assembly 290, when connected to the gas shut-off control box 250 of FIG. 13, uses dry contacts 294 and when connected to the electric shut-off interface arrangement 210 uses dry contacts 296. The interface enclosure assembly 290 is connected by an electrical connector 298 to either the electrical connector 226 on the electric shut-off interface arrangement 210 or the electrical connector 282 on the gas shut-off control box 250.

Referring now to FIG. 15 there is shown an optional audible alarm and strobe assembly 300 which strobes the word "fire" 302 and sounds an audible alarm 304. The alarm and strobe assembly 300 is connected by an electrical connector 306 to the connector 280 of the gas shut-off control box 250 or the connector 220 of the electric shut-off interface arrangement 210. As is seen in FIG. 16, there are three prongs for both the audible alarm 304 and the fire detectors 152 are connected by a line 156 to a control box 158 which includes the circuitry of FIG. 7.

Figure 17:
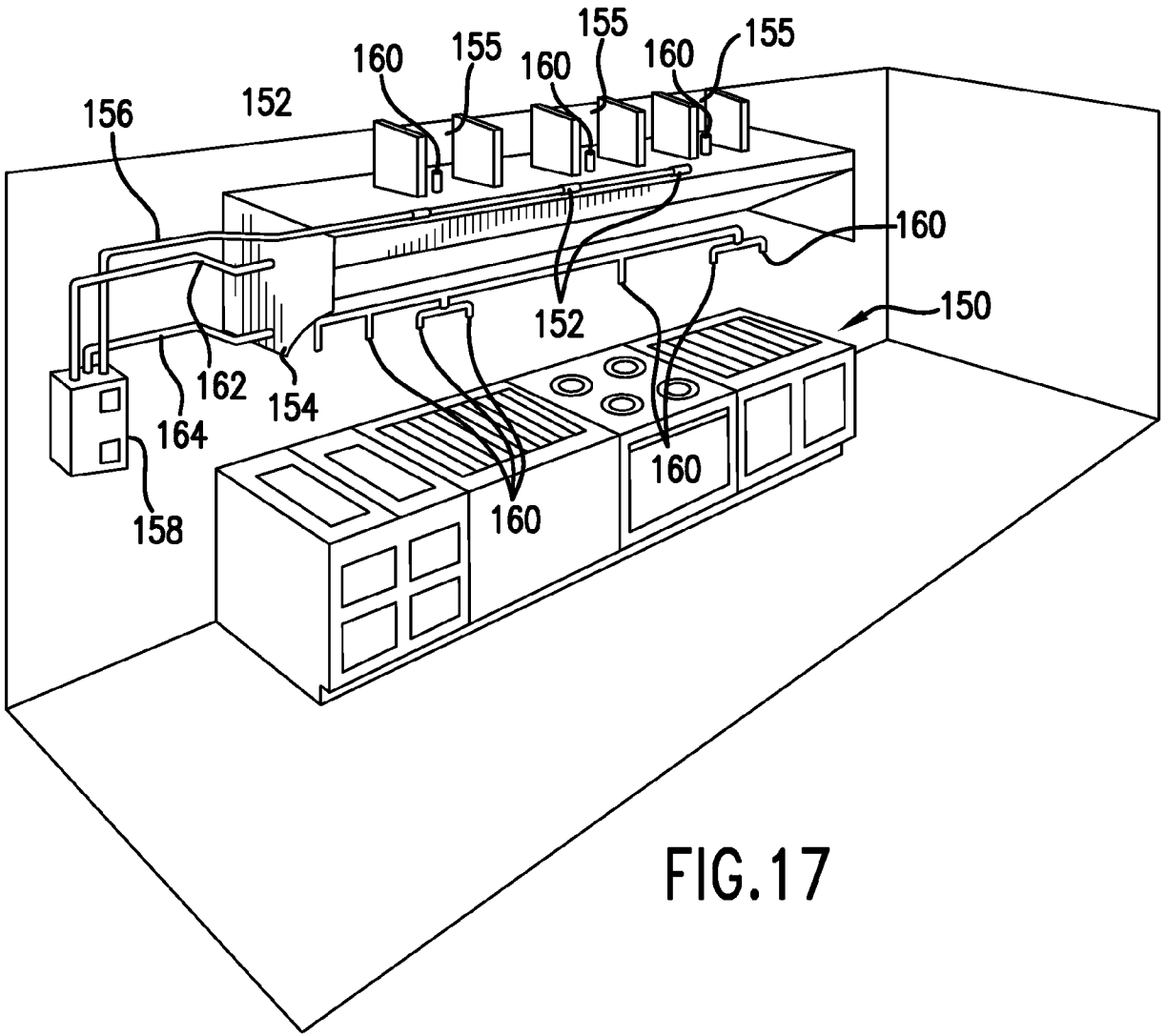
FIG. 17 is a perspective view of a commercial range and range hood for use in restaurants or in an elaborate residential cook stove, which commercial range and range hood includes a control system configured in accordance with the present invention.

In the arrangement of FIG. 17,nozzles 160 are mounted in the hood 154. The nozzles 160 are connected by a discharge piping 162 and 164 to a fire extinguisher within the control box 158. Some of the nozzles 162 are directed toward the range 150 while others of the nozzles 162 are directed to discharge into the exhaust ducts 155 where grease tends to accumulate.

All the United States patents cited herein are incorporated herein by reference.

From the foregoing description, one skilled in the art can easily ascertain in the essential characteristics of this invention, and without departing from the spirit and scope thereof, can make various changes and modifications of the invention to adapt it to various usages and conditions.

What is claimed is:

1. A system for detecting a fire at an electric cook-stove and for interrupting the supply of electricity to burners of the electric cook-stove upon the occurrence of a fire, comprising:

a sensor for detecting the occurrence of a fire;

a shut-off switch that when opened interrupts for interrupting the supply of electricity to the burner of the cook-stove;

a source of current for the shut-off switch;

an audible alarm connected to the sensor to emit an audible signal upon the sensor detecting a fire;

an interface arrangement disposed between the source of electric current for the shut-off switch and the shut-off switch, the interface arrangement being external to a control panel;

an electrical connector at the interface arrangement, and a hardwire connection for connecting the electrical connector on the interface arrangement to the shut-off switch when the alarm is not acoustically connected to the shut-off switch, and a sonic receiver separate from the shut-off switch for acoustically detecting the occurrence of an alarm signal the sonic receiver generating an output signal to an electrical connector attached thereto when connected to the connector on the interface arrangement so as to operate the shut-off switch acoustically when the sonic receiver replaces the hardwire connection.

2. The system of claim 1 wherein the interface arrangement includes a reset switch to reclose the electric shut-off switch so that the cook stove can be conveniently reused after the occurrence of a fire.

3. The system of claim 2 wherein the interface arrangement includes a strobe light to give a visual signal, both locally and remotely, that a fire has secured.

4. The system of claim 1 further including an interface enclosure assembly including an electrical connector for connection with an electrical connector on the interface arrangement to provide dry contacts to external devices including automatic telephone dialers, monitored security alarm systems and other warning protective systems.

5. A system for detecting a fire at a gas cook stove and for interrupting the supply of gas to burners of the gas cook stove upon the occurrence of a fire, comprising:

a sensor for detecting the occurrence of a fire;

a shut-off switch interrupting the supply of gas to the burner of the cook stove by allowing the gas supply valve to assume a closed position;

a source of current for the shut-off switch;

an audible alarm connected to the sensor to emit an audible signal upon the sensor detecting a fire;

an interface arrangement disposed between the source of electric current for the shut-off switch and the shut-off switch, the interface arrangement being external to a control panel;

an electrical connector at the interface arrangement, a hardwire connection for connecting the electrical connector at the interface arrangement to the shut-off switch when the alarm is not acoustically connected to the shut-off switch, and a sonic receiver for acoustically detecting the occurrence of an alarm signal, the sonic receiver generating an output signal to an electrical connector connected to the connector on the interface arrangement to operate the shut-off switch acoustically when the sonic receiver replaces the hardwire connection.

6. The system of claim 5, wherein the gas supply valve is normally open.

7. The system of claim 6, wherein the interface arrangement includes a reset switch to reset the gas supply valve to the open position so that the gas cook stove can be conveniently be reused after the occurrence of a fire.

8. The system of claim 7, wherein the interface arrangement includes a strobe light to give a visual signal, both locally and remotely, that a fire has occurred.

9. The system of claim 6 further including an interface enclosure assembly including an electrical connector for connection with an electrical connector on the interface arrangement to provide dry contacts to external devices including automatic telephone dialers, monitored security alarm systems and other warning protective systems.

* * * * *